US007048061B2

(12) United States Patent
Bode et al.

(10) Patent No.: US 7,048,061 B2
(45) Date of Patent: May 23, 2006

(54) SCREEN ASSEMBLY WITH FLOW THROUGH CONNECTORS

(75) Inventors: Jeffrey Bode, The Woodlands, TX (US); Craig Fishbeck, Conroe, TX (US); Tyson L. Dailey, Katy, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/372,631

(22) Filed: Feb. 21, 2003

(65) Prior Publication Data

US 2004/0163804 A1 Aug. 26, 2004

(51) Int. Cl.
*E21B 43/08* (2006.01)

(52) U.S. Cl. ..... 166/369; 166/205; 166/227; 166/236; 166/380

(58) Field of Classification Search ..... 166/369
See application file for complete search history.

(56) References Cited

U.S. PATENT DOCUMENTS 1,473,644 A * 11/1923 Rodrigo, Sr. ..... 166/205
3,739,845 A 6/1973 Berry et al.
3,741,300 A * 6/1973 Wolff et al. ..... 166/184
3,951,338 A 4/1976 Genna
4,373,582 A 2/1983 Bednar et al.
4,510,996 A * 4/1985 Hardin ..... 166/227
4,936,386 A 6/1990 Colangelo
5,183,114 A 2/1993 Mashaw, Jr. et al.
5,240,074 A 8/1993 Peavy et al.
5,343,949 A * 9/1994 Ross et al. ..... 166/278
5,372,193 A 12/1994 French
5,465,787 A 11/1995 Roth
5,515,915 A * 5/1996 Jones et al. ..... 166/51
5,524,937 A 6/1996 Sides, III et al.
5,609,204 A 3/1997 Rebardi et al. ..... 166/51
5,662,165 A 9/1997 Tubel et al.

(Continued)

FOREIGN PATENT DOCUMENTS

EP 0 999 341 5/2000

(Continued)

OTHER PUBLICATIONS

Baker-Hughes Product Announcement, "EQUALIZER™", Apr. 15, 1998, 2pps.

*Primary Examiner*—Hoang Dang
(74) *Attorney, Agent, or Firm*—Patterson & Sheridan

(57) ABSTRACT

A connector for providing a pathway between a first screened tubing and a second screened tubing. In one embodiment, the connector includes an annular pipe coupled to the first screened tubing at a first end and coupled to the second screened tubing at a second end. The annular pipe defines a plurality of channels disposed therein. The channels are configured to provide the pathway between the first screened tubing and the second screened tubing.

36 Claims, 3 Drawing Sheets

U.S. PATENT DOCUMENTS

| | | | | |
|---|---|---|---|---|
| 5,803,179 | A | 9/1998 | Echols et al. | |
| 5,829,522 | A | 11/1998 | Ross et al. | 166/228 |
| 5,833,004 | A * | 11/1998 | Coronado | 166/382 |
| 5,865,251 | A | 2/1999 | Rebardi et al. | 166/278 |
| 5,868,200 | A * | 2/1999 | Bryant et al. | 166/51 |
| 5,896,928 | A * | 4/1999 | Coon | 166/373 |
| 5,927,401 | A | 7/1999 | Morris et al. | |
| 6,189,619 | B1 | 2/2001 | Wyatt et al. | 166/332.1 |
| 6,247,536 | B1 | 6/2001 | Leismer et al. | |
| 6,286,594 | B1 | 9/2001 | French | |
| 6,302,208 | B1 * | 10/2001 | Walker et al. | 166/278 |
| 6,311,772 | B1 * | 11/2001 | Myhre et al. | 166/278 |
| 6,318,465 | B1 * | 11/2001 | Coon et al. | 166/278 |
| 6,325,150 | B1 | 12/2001 | Rayssiguier | |
| 6,371,210 | B1 * | 4/2002 | Bode et al. | 166/370 |
| 6,405,800 | B1 | 6/2002 | Walker et al. | |
| 6,481,494 | B1 * | 11/2002 | Dusterhoft et al. | 166/51 |
| 6,644,404 | B1 * | 11/2003 | Schultz et al. | 166/278 |
| 6,715,545 | B1 * | 4/2004 | McGregor et al. | 166/235 |
| 6,786,285 | B1 | 9/2004 | Johnson et al. | |
| 2002/0189809 | A1 * | 12/2002 | Nguyen et al. | 166/278 |
| 2003/0029613 | A1 | 2/2003 | Danos et al. | |
| 2004/0020832 | A1 * | 2/2004 | Richards et al. | 210/106 |

FOREIGN PATENT DOCUMENTS

| | | |
|---|---|---|
| EP | 1 055 797 A2 | 11/2000 |
| GB | 2 339 226 A | 1/2000 |
| WO | WO 98/36155 | 8/1998 |
| WO | WO 00/29715 | 5/2000 |
| WO | WO 00/45031 | 8/2000 |
| WO | WO 00/47867 | 8/2000 |

* cited by examiner

SCREEN ASSEMBLY WITH FLOW THROUGH CONNECTORS

BACKGROUND OF THE INVENTION

1. Field of the Invention

Embodiments of the present invention generally relate to an apparatus and method for opening and closing flow passages through a tubular body, and more particularly, to a system for controlling the flow of fluids in wellbore operations.

2. Description of the Related Art

FIG. 1 shows a cross-sectional view of a typical hydrocarbon well 10. The well 10 includes a vertical wellbore 12 and thereafter a horizontal wellbore 14, formed by using some means of directional drilling, such as a diverter. The horizontal wellbore 14 is used to more completely and effectively reach formations bearing oil or other hydrocarbons. In FIG. 1, the vertical wellbore 12 has a casing 16 disposed therein while the horizontal wellbore 14 has no casing disposed therein.

After the wellbore 12 is formed and lined with casing 16, a string of production tubing 18 is run into the well 10 to provide a pathway for hydrocarbons to the surface of the well 10. The well 10 oftentimes has multiple hydrocarbon bearing formations, such as oil-bearing formations 20, 21, 22 and/or gas bearing formations 24. Typically, packers 26 are used to isolate one formation from another. The production tubing 18 generally includes multiple joints of screened tubing 28. To recover hydrocarbons from a formation where there is casing 16 disposed in the wellbore, such as at formations 20 and 21, perforations 30 are formed in the casing 16 and in the formation to allow the hydrocarbons to enter the wellscreen through the casing 16.

Each joint of screened tubing 28 typically includes a perforated inner tubing (not shown) surrounded by a wellscreen. The purpose of the wellscreen is to allow inflow of hydrocarbons into the production tubing 18 while blocking the flow of unwanted material. Each end of the wellscreen is generally welded to an end ring, which is coupled to the perforated inner tubing. The end rings are configured such that fluids or hydrocarbons generally cannot flow past the end rings. A sliding sleeve (not shown) may be positioned inside the perforated inner tubing. The sliding sleeve is generally used to open and close subsurface access openings (or perforations) disposed on the perforated inner tubing to inject fluid into the formation or to produce fluid from the formation. Without this sliding sleeve, each joint would not be able to inject fluid into the formation or to produce fluid from the formation. In this manner, each joint of screened tubing 28 typically includes a sliding sleeve. Thus, a production tubing for a formation that spans thousands of feet (e.g., a horizontal or lateral wellbore) generally consists of hundreds of joints of screened tubing, each having its own sliding sleeve. Since sliding sleeves are costly (e.g., about $15,000 to about $20,000 for each sleeve), the cost to complete a deep well having a depth of several thousand feet, for example, can be cost prohibitive, in view of the number of sliding sleeves used in the production tubing.

Therefore, a need exists for a more cost effective apparatus and method for controlling the flow of fluids into a production tubing.

SUMMARY OF THE INVENTION

Embodiments of the present invention are generally directed to a connector for providing a pathway between a first screened tubing and a second screened tubing. In one embodiment, the connector includes an annular pipe coupled to the first screened tubing at a first end and coupled to the second screened tubing at a second end. The annular pipe defines a plurality of channels disposed therein. The channels are configured to provide the pathway between the first screened tubing and the second screened tubing.

Embodiments of the present invention are also generally directed to a screened tubing assembly, which includes a string of screened tubings. Each screened tubing includes a screen annularly disposed thereon. The assembly further includes a connector disposed between each screen. The connector defines a pathway between each screened tubing.

In one embodiment, the screened tubing assembly includes a string of screened tubings. Each screened tubing includes a screen annularly disposed thereon. The assembly further includes a connector disposed between each screen. The connector provides a pathway between each screened tubing. One of the screened tubings includes a perforated inner tubing having a plurality of holes disposed thereon and a sliding sleeve configured to open and close the holes.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 2:
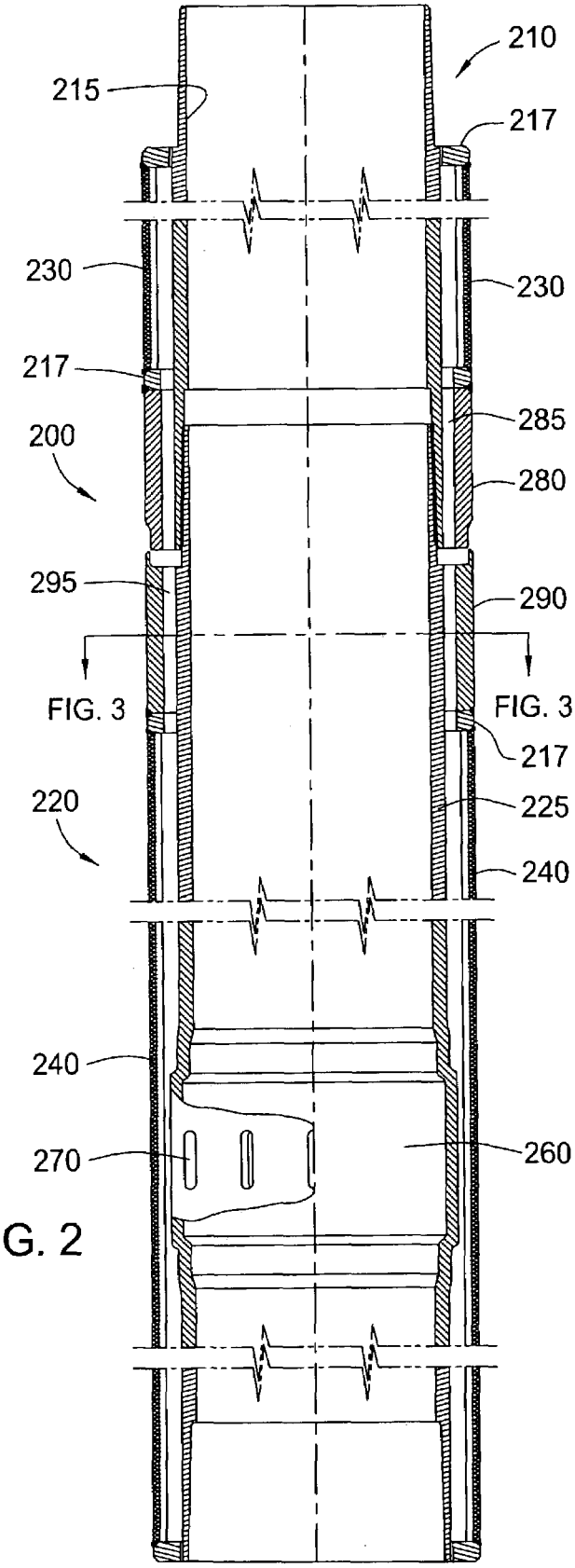
FIG. 2 illustrates two screened tubings joined together in accordance with an embodiment of the invention.

FIG. 2 illustrates two screened tubings joined together in accordance with an embodiment of the invention. These two screened tubings are adapted to be part of a screened tubing assembly that spans a subsurface formation to be produced. In general, the screened tubing assembly is used to inject fluid slurries from the screened tubing assembly into the subsurface formation to fracture and prop open the subsurface formation surrounding the well bore. After the subsurface formation has been fractured, the screened tubing assembly is used to convey well fluids back to the well surface.

More specifically, FIG. 2 illustrates screened tubing 210 and screened tubing 220. Screened tubing 210 includes an inner tubing 215 and a screen 230 coupled to the inner tubing 215. The screen 230 may be coupled to the inner tubing 215 by welding and the like. The screen 230 may also be coupled to the inner tubing 215 through an end ring 217. As previously mentioned, the screen 230 is generally configured to allow the inflow of fluids into the inner tubing 215 while blocking the inflow of unwanted materials. In this embodiment, however, the inner tubing 215 is not perforated, i.e., the inner tubing 215 has no holes disposed thereon. Screened tubing 210 further includes a male portion 280 of a connector 200 coupled to the screen 230. The male portion 280 may be coupled to the screen 230 by welding and the like. The male portion 280 may also be coupled to the screen 230 through an end ring 217. The male portion 280 defines a plurality of channels 285 annularly disposed along the inner tubing 215. Channels 285 are also defined through the end ring 217, if the male portion 280 is coupled to the end ring 217. In one embodiment, the male portion 280 is formed near an end of the inner tubing 215.

Screened tubing 220 includes an inner tubing 225 and a screen 240 coupled to the inner tubing 225. The screen 240 may be coupled to the inner tubing 225 by welding and the like. The screen 240 may also be coupled to the inner tubing 225 through an end ring 217. Unlike inner tubing 215, inner tubing 225 defines a plurality of holes 270 disposed thereon. Screened tubing 220 further includes a female portion 290 of the connector 200 coupled to the screen 240. The female portion 290 may be coupled to the screen 240 by welding and the like. The female portion 290 may also be coupled to the screen 240 through an end ring 217. Like the male portion 280, the female portion 290 defines a plurality of channels 295 annularly disposed along the inner tubing 225. In one embodiment, the female portion 290 is formed near an end of the inner tubing 225 such that the male portion 280 may be joined with the female portion 290 to form the connector 200.

Screened tubing 220 further includes a sliding sleeve 260, which is shown in FIG. 2 in a closed position. The sliding sleeve 260 may be disposed outside or inside of the perforated inner tubing 225. As mentioned above, the sliding sleeve 260 is generally used to open and close the holes 270 on the perforated inner tubing 225 to inject fluid into the formation or to produce fluid from the formation. Details of the sliding sleeve 225 are described in commonly assigned U.S. Pat. No. 6,189,619, issued to Wyatt et al., entitled "Sliding Sleeve Assembly For Subsurface Flow Control", which is incorporated by reference herein to the extent not inconsistent with embodiments of the invention.

Figure 1:
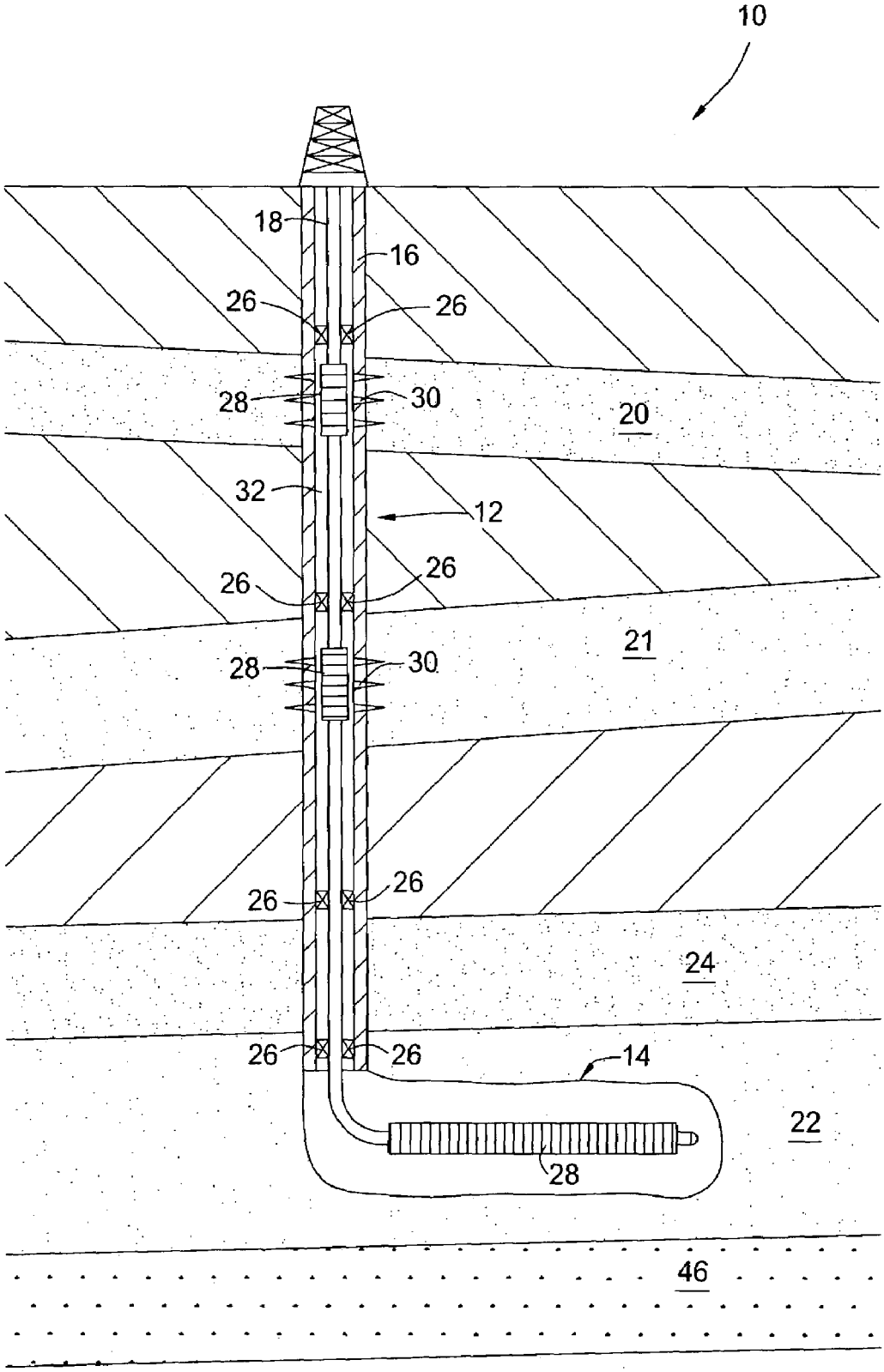
FIG. 1 illustrates a cross-sectional view of a typical hydrocarbon well.
Figure 3:
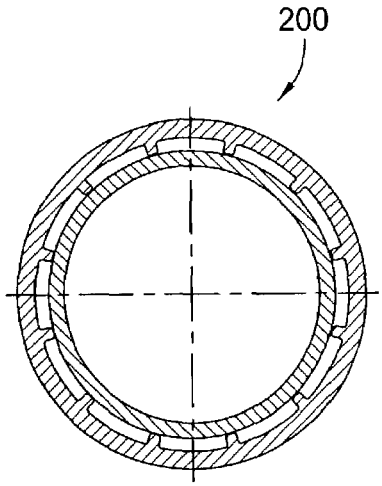
FIG. 3 illustrates a cross sectional view of a connector in accordance with an embodiment of the invention.

In accordance with one embodiment of the invention, the connector 200 is formed when screened tubing 210 and screened tubing 220 are joined together. When screened tubing 210 and screened tubing 220 are joined together, the male portion 280 of the connector 200 is coupled to the female portion 290 of the connector 200. Screened tubing 210 and screened tubing 220 may be joined by threading or other similar means. In one embodiment, the male portion 280 may be coupled to the female portion 290 by press fitting or interference fitting and the like. When the male portion 280 and the female portion 290 are coupled, channels 285 and channels 295 form a pathway for fluids to travel from screened tubing 210 to screened tubing 220, or vice versa. In this manner, the channels are annularly formed along an intersection of screened tubing 210 and screened tubing 220. A cross sectional view of the connector 200 in accordance with an embodiment of the invention is illustrated in FIG. 3. In operation, the fluids entering screen 230 are configured to flow through the channels formed by channels 285 and channels 295 to screened tubing 220, which includes the sliding sleeve 260. When the sliding sleeve 260 is in an open position, the fluids are directed to flow into the perforated inner tubing 225 and into the production tubing (not shown).

The sliding sleeve 260 may be shifted axially between its open and closed positions by a shifting tool (not shown). In the open position, fluids or formation material (such as hydrocarbons) is configured to move through screen 240 and holes 270 on the inner tubing 225 into a central passageway inside the inner tubing 225. The fluids are then configured to move upwardly through the interior of the screened tubing assembly. In the closed position, the sliding sleeve 260 is configured to preclude fluids to flow between an outside portion of the perforated inner tubing 225 and an inside portion of the perforated inner tubing 225. The sliding sleeve 260 may be opened and closed by hydraulic pressure or an electrical current supplied by a control line. Details of various control mechanisms are described in commonly assigned U.S. Pat. No. 6,371,210, entitled "Flow Control Apparatus For Use In A Wellbore", issued to Bode et al. and in commonly assigned U.S. patent Ser. No. 09/844,748 filed Apr. 25, 2001, entitled "Flow Control Apparatus For Use In A Wellbore", by Bode et al., both of which are incorporated by reference herein to the extent not inconsistent with the invention.

In accordance with one embodiment of the invention, several screened tubings may be coupled or joined using connectors, such as, the connector 200. That is, a series of screened tubings may be coupled together before a sliding sleeve is coupled to the series of screened tubings. In this manner, fluids may flow through several combinations of screens (such as screen 230) and channels defined by the connectors before reaching a sliding sleeve (such as sliding sleeve 260). Using this configuration, the number of sliding sleeves used in a screened tubing assembly is significantly reduced, thereby reducing the cost for completing deep wells.

Figure 4:
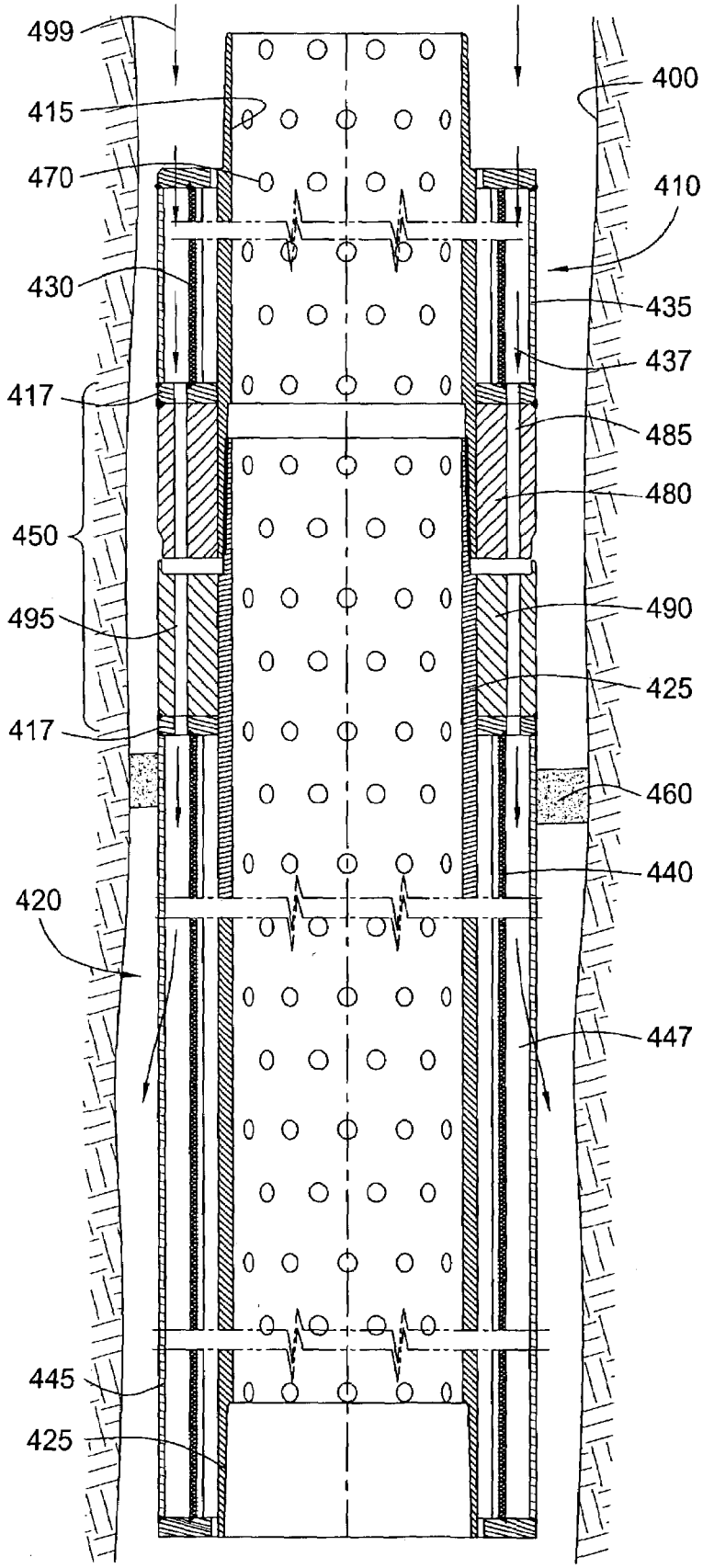
FIG. 4 illustrates two screened tubings joined together in accordance with another embodiment of the invention.

FIG. 4 illustrates a screened tubing 410 and a screened tubing 420 configured to be used during a gravel packing operation in accordance with an embodiment of the invention. Screened tubing 410 and screened tubing 420, when joined, form a connector 450 configured to provide a pathway for gravel slurry to travel from screened tubing 410 to screened tubing 420. During gravel packing operation, gravel slurry is typically pumped at high pressures down a production tubing (not shown). The gravel slurry is then directed to an annular area between the casing lining a wellbore 400 and the screened tubings. Often times, however, one or more gravel bridges (e.g., a premature gravel bridge 460) may form prematurely between the screened tubings and the metal casing lining the wellbore 400. If the premature gravel bridge 460 is formed near an end of a screened tubing (as shown in FIG. 4), the premature gravel bridge 460 may hinder gravel slurry from flowing pass the end of the screened tubing. Accordingly, the connector 450 is configured to provide an alternate pathway for gravel slurry in the event gravel bridges are prematurely formed near screened tubing ends. More specifically, screened tubing 410 includes an inner tubing 415 and an annular screen 430 coupled to the inner tubing 415. The screen 430 may also be coupled to the inner tubing 415 through an end ring 417. As previously mentioned, the screen 430 is generally configured to allow the inflow of fluids into the inner tubing 415 while blocking the inflow of unwanted materials. Inner tubing 415 defines a plurality of holes 470 disposed thereon. A perforated tube 435 is disposed around screen 430 to form an annular space 437 therebetween. The perforated tube 435 defines perforations that are typically large enough to pass through gravel and sand. The holes 470 disposed on the screen 430, however, are typically large enough to pass through only liquids and/or hydrocarbons, and not gravel.

Screened tubing 410 further includes a male portion 480 of the connector 450 coupled to the screen 430. The male portion 480 may be coupled to the screen 430 by welding and the like. The male portion 480 may also be coupled to the screen 430 through an end ring 417. The male portion 480 defines channels 485 annularly disposed along the inner tubing 415. In one embodiment, the male portion 480 is formed near an end of the inner tubing 415.

Screened tubing 420 includes an inner tubing 425 and a screen 440 coupled to inner tubing 425. Screen 440 may also be coupled to inner tubing 425 through an end ring 417. Inner tubing 425 defines a plurality of holes 470 disposed thereon. A perforated tube 445 is disposed around screen 440 to form an annular space 447 therebetween. The perforated tube 445 defines perforations that are typically large enough to pass through gravel and sand. The holes 470 disposed on the screen 440, however, are typically large enough to pass through only liquids and/or hydrocarbons, and not gravel. Screened tubing 420 further includes a female portion 490 of the connector 450 coupled to screen 440. The female portion 490 may be coupled to screen 440 by welding and the like. The female portion 490 may also be coupled to screen 440 through an end ring 417. Like the male portion 480, the female portion 490 defines channels 495 annularly disposed along inner tubing 425. In one embodiment, the female portion 490 is formed near an end of inner tubing 425 such that the male portion 480 may be joined with the female portion 490 to form the connector 450.

In accordance with one embodiment of the invention, the connector 450 is formed when screened tubing 410 and screened tubing 420 are joined together. When screened tubing 410 and screened tubing 420 are joined together, the male portion 480 of the connector 450 is coupled to the female portion 490 of the connector 450. Screened tubing 410 and screened tubing 420 may be joined by threading or other similar means. In one embodiment, the male portion 480 may be coupled to the female portion 490 by press fitting or interference fitting and the like. When the male portion 480 and the female portion 490 are coupled, channels 485 and channels 495 form a pathway for gravel slurry from screened tubing 410 to screened tubing 420. In this manner, gravel slurry entering annular space 437 through perforated tube 435 may travel through the pathway formed by channels 485 and channels 495 to annular space 447, thus bypassing the premature gravel bridge 460. Gravel slurry may then continue to travel through the perforated tube 445 to the annular area surrounding the screened tubings or to subsequent screened tubings. An embodiment of the entire flow of the gravel slurry is depicted as arrows 499.

While the foregoing is directed to embodiments of the present invention, other and further embodiments of the invention may be devised without departing from the basic scope thereof, and the scope thereof is determined by the claims that follow.

What is claimed is:

1. A screened tubing assembly, comprising:

a string of screened tubings, wherein each screened tubing comprises a screen annularly disposed thereon and a perforated tube disposed around the screen to form an annular space therebetween; and a connector disposed between each screen, wherein the connector defines a pathway between each screened tubing; and wherein one or more of the screened tubings includes a flow control device for controlling fluid flow into and out of the screened tubings.

2. The assembly of claim 1, wherein the connector comprises a plurality of channels that defines the pathway.

3. The assembly of claim 2, wherein the channels are annularly disposed through the connector.

4. The assembly of claim 2, wherein the channels are configured to transmit one of fluids, hydrocarbons or gravel slurry between each screened tubing.

5. The assembly of claim 1, wherein each screened tubing further includes a perforated tube disposed around the screen to form an annular space therebetween.

6. The assembly of claim 1, wherein the perforated tube comprises at least one perforation permeable to a packing material.

7. The assembly of claim 6, wherein the screen is not permeable to the packing material.

8. The assembly of claim 6, wherein the packing material comprises at least one of sand and gravel.

9. A screened tubing assembly, comprising:

a string of screened tubings, wherein each screened tubing includes a screen annularly disposed thereon;

a connector disposed between each screen, wherein the connector comprises a male portion and a female portion and provides a pathway between each screened tubing; and wherein one of the screened tubings comprises:

a perforated inner tubing having a plurality of holes disposed thereon; and a sliding sleeve configured to open and close the holes.

10. The assembly of claim 9, wherein the pathway comprises a plurality of channels annularly disposed along at least a portion of each of the screened tubings.

11. The assembly of claim 9, wherein the pathway allows fluids to travel from the screened tubings to the one of the screened tubings.

12. The assembly of claim 9, wherein the pathway allows fluids to travel from the screened tubings to the sliding sleeve.

13. The assembly of claim 9, wherein the pathway allows fluids from the screened tubings to flow into the perforated inner tubing when the sliding sleeve is in an open position.

14. The assembly of claim 9, wherein the connector comprises a male portion and a female portion.

15. The assembly of claim 9, wherein one of the male portion or the female portion of the connector is disposed at an end of each screened tubing.

16. The assembly of claim 9, wherein the male portion is configured to mate with the female portion.

17. The assembly of claim 9, wherein the male portion is configured to be one of pressed fitted or interference fitted with the female portion.

18. The assembly of claim 9, wherein the male portion is configured to mate with the female portion when the screened tubings are coupled together.

19. The assembly of claim 9, wherein the screen is coupled to one of the male portion or the female portion.

20. The assembly of claim 9, wherein the sliding sleeve is disposed inside the perforated inner tubing.

21. The assembly of claim 9, wherein the screened tubings are coupled together via a threadable connection.

22. The assembly of claim 9, wherein each screened tubing comprises an inner tubing.

23. The assembly of claim 22, wherein the screen is disposed around the inner tubing.

24. The assembly of claim 9, wherein the one of the screened tubings comprises a screen disposed around the sliding sleeve.

25. The assembly of claim 9, wherein the sliding sleeve, when set in the closed position, is configured to preclude fluids to flow between an outside portion of the perforated inner tubing and an inside portion of the perforated inner tubing.

26. The assembly of claim 9, wherein the sliding sleeve, when set in the open position, is configured to allow fluids to flow between an outside portion of the perforated inner tubing and an inside portion of the perforated inner tubing.

27. The assembly of claim 12, wherein the pathway allows fluids from the screened tubings to flow into the perforated inner tubing when the sliding sleeve is in an open position.

28. The assembly of claim 12, wherein the pathway comprises a plurality of channels annularly disposed along at least a portion of each of the screened tubings.

29. The assembly of claim 18, wherein the pathway for allows fluids to travel from the screened tubings to the sliding sleeve.

30. The assembly of claim 29, wherein the pathway further allows fluids from the screened tubings to flow into the perforated inner tubing when the sliding sleeve is in an open position.

31. A connector for providing a pathway between a first screened tubing and a second screened tubing, comprising:

an annular pipe coupled to the first screened tubing at a first end and coupled to the second screened tubing at a second end, wherein the annular pipe defines a plurality of channels disposed therein, wherein the channels are configured to provide the pathway between the first screened tubing and the second screened tubing, wherein the connector comprises a male portion and a female portion, and wherein the male portion is configured to be one of pressed fit or interference fit with the female portion.

32. A method for controlling fluid flow through a tubular, comprising:

providing the tubular with a flow control device and a plurality of perforated outer tubulars;

positioning a screen tubing between the tubular and the plurality of perforated outer tubulars;

placing the plurality of perforated outer tubulars in fluid communication;

directing fluid flow through the plurality of perforated outer tubulars toward the flow control device; and operating the flow control device to control fluid flow through the tubular.

33. The method of claim 32, wherein one or more connection tubulars are used to place the plurality of perforated outer tubulars in fluid communication.

34. The method of claim 33, wherein the one or more connection tubulars comprise at least one fluid channel.

35. The method of claim 32, wherein an annular area is formed between the tubular and the plurality of perforated outer tubulars.

36. The method of claim 35, wherein the flow control device is adapted to selectively control fluid flow between the annular area and an inner portion of the tubular.

* * * * *